US009957095B2

(12) United States Patent
Perrulli et al.

(10) Patent No.: US 9,957,095 B2
(45) **Date of Patent: *May 1, 2018**

(54) COMBINED WINE GLASS AND WINE BOTTLE PACKAGE

(71) Applicant: govino, LLC, St. Helena, CA (US)

(72) Inventors: Joseph T. Perrulli, St. Helena, CA (US); Boyd I. Willat, Venice, CA (US)

(73) Assignee: govino, LLC, Newport Beach, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/985,272

(22) Filed: Dec. 30, 2015

(65) Prior Publication Data

US 2016/0107815 A1 Apr. 21, 2016

Related U.S. Application Data

(63) Continuation of application No. 12/939,658, filed on Nov. 4, 2010, now Pat. No. 9,227,772.

(Continued)

(51) Int. Cl.
*B65D 77/00* (2006.01)
*B65D 77/04* (2006.01)

(Continued)

(52) U.S. Cl.
CPC ..... *B65D 77/0493* (2013.01); *A47G 19/2205* (2013.01); *B65D 1/0261* (2013.01);

(Continued)

(58) Field of Classification Search
CPC ..... B65D 5/667; B65D 41/00; B65D 41/16; B65D 41/18; B65D 41/22; B65D 77/0493; B65D 1/0276; B65D 1/265; B65D 1/0261; B65D 41/04; B65D 41/26; B65D 75/002; B65D 85/72; A47G 19/2205

(Continued)

(56) References Cited

U.S. PATENT DOCUMENTS 3,039,132 A * 6/1962 Hambley ..... A45D 34/041 192/16
3,159,298 A * 12/1964 Saw ..... A47J 41/0011 215/228

(Continued)

FOREIGN PATENT DOCUMENTS

WO WO 89/05269 6/1989

*Primary Examiner* — Rafael Ortiz
(74) *Attorney, Agent, or Firm* — Lowry Blixseth LLP; Scott M. Lowry

(57) ABSTRACT

A combined wine glass and wine bottle package includes a wine glass constructed from molded plastic with an upper shell-shaped body defining an upwardly narrowing tapered flume of generally uniform thickness and a contoured lower base defining an annular moat surrounding a central punt. A wine bottle is sized to fit substantially into the wine glass in an inverted orientation with a removable bottle cap nested within the central punt, and with an upper rim of the wine bottle snap-fitted into a shallow groove formed in the wine bottle near a lower end thereof. This entire package is sterile-wrapped in a sealed shrink-wrap plastic or the like. The package can be opened when desired to permit removal of the wine bottle from the wine glass, following by bottle opening and pouring of the contents into the wine glass.

16 Claims, 3 Drawing Sheets

Related U.S. Application Data

(60) Provisional application No. 61/266,210, filed on Dec. 3, 2009.

(51) Int. Cl.

| | |
|---|---|
| ***B65D 1/02*** | (2006.01) |
| ***B65D 1/26*** | (2006.01) |
| ***B65D 41/04*** | (2006.01) |
| ***B65D 75/00*** | (2006.01) |
| ***B65D 41/26*** | (2006.01) |
| ***A47G 19/22*** | (2006.01) |
| ***B65D 85/72*** | (2006.01) |

(52) U.S. Cl.
CPC ..... *B65D 1/0276* (2013.01); *B65D 1/265* (2013.01); *B65D 41/04* (2013.01); *B65D 41/26* (2013.01); *B65D 75/002* (2013.01); *B65D 85/72* (2013.01); *B65D 1/0246* (2013.01)

(58) Field of Classification Search
USPC ..... 206/217, 307; 220/699, 703; 215/387, 215/393, 365
See application file for complete search history.

(56) References Cited

U.S. PATENT DOCUMENTS

| | | | | |
|---|---|---|---|---|
| 4,230,230 | A * | 10/1980 | Mumford | B65D 41/18 215/277 |
| 4,273,247 | A | 6/1981 | Earls | |
| 4,544,073 | A * | 10/1985 | Willis | B65D 51/18 215/12.1 |
| 4,630,742 | A | 12/1986 | Miyaji et al. | |
| 4,693,410 | A * | 9/1987 | Selz | A47G 19/2205 215/228 |
| 6,662,959 | B1 | 12/2003 | Westerhold | |
| 7,273,147 | B2 | 9/2007 | Willat et al. | |
| 7,404,345 | B1 * | 7/2008 | Dipprey | B67B 7/16 81/3.09 |
| D577,547 | S * | 9/2008 | Willat | D7/509 |
| 2005/0039416 | A1 | 2/2005 | Hidding | |
| 2005/0092760 | A1 | 5/2005 | Westerhold | |
| 2007/0119726 | A1 | 5/2007 | Willat et al. | |
| 2007/0144932 | A1 | 6/2007 | Willat et al. | |
| 2008/0011706 | A1 | 1/2008 | Downing et al. | |

* cited by examiner

COMBINED WINE GLASS AND WINE BOTTLE PACKAGE

BACKGROUND OF THE INVENTION

This invention relates generally to a convenient and compact commercial unit or package comprising the combination of a wine glass with a bottle of wine or other selected beverage contained therein, wherein the package can be opened by the consumer and the contents of the wine bottle or the like poured into the wine glass for consumption. The wine glass and wine bottle may be conveniently and economically disposed after use.

A commercial unit or package comprising a drinking vessel such as a wine glass in combination with a beverage-containing bottle such as a wine glass is, in general, known in the art. See, e.g., WO 89/05269, which discloses a wine glass or cup positioned in an inverted orientation atop a wine bottle or the like, with the glass or cup including an internal cap portion or segment adapted to sealingly fit with and close the bottle. To open the bottle, the inverted glass or cup is rotatably removed from the bottle, whereupon the bottle contents can be poured directly into the glass or cup for consumer enjoyment. The glass or cup, as well as the bottle, are preferably formed from a molded plastic material selected for oxygen imperviousness, thereby safeguarding the bottle contents against oxygen ingress and resultant degradation.

The combination package of WO 89/05269, however, exhibits a number of commercial drawbacks or disadvantages, whereby this combination package has not achieved broad market acceptance or use. By way of example, the combination package relies upon a direct sealed engagement between the glass or cup and the beverage-containing bottle. But the glass or cup has a wine glass shape having a receptacle supported at the upper end of an elongated stem which projects upwardly from a relatively broad base, with the sealing cap segment formed in the bottom of the receptacle. As a result, the elongated stem and base of the glass or cup extend, when inverted, above the bottle to provide a combination package that is relatively tall. This tall package, while constructed from plastic and thus relatively lightweight, is not conducive to convenient shipping, handling, or storage, without significant risk of bumping the glass or cup sufficiently to break the bottle seal, and thereby allow the bottle contents to spoil.

Additional disadvantages include the non-tapering or non-flumed geometry of the wine glass, in order to achieve relatively minimal package width. This wine glass geometry is also more prone to spillage. Furthermore, the wine glass has a volumetric capacity that is significantly less than the capacity of the wine bottle, whereby the entire bottle contents cannot be poured in a single pouring action into the wine glass. Instead, the consumer must retain the now-open bottle with residual wine therein, and wait until at least part of the wine is consumed from the glass before the residual wine can be poured into the glass.

There exists, therefore, a significant need for an improved commercial unit or package wherein a glass or cup, such as a wine glass, is combined with a beverage-containing bottle, such as a wine bottle, in a compact and stable configuration for safeguarding the bottle contents against inadvertent opening and spoilage, while further providing for convenient bottle opening so that the contents can be enjoyed by means of the glass or cup. The present invention fulfills these needs and provides further related advantages.

SUMMARY OF THE INVENTION

In accordance with the invention, a combined wine glass and wine bottle package includes a wine glass or the like constructed from molded plastic or the like for substantially snap-fit assembly with a beverage-containing bottle, such as a wine bottle, which can be formed from a conventional beverage-protecting glass or molded plastic material and having a conventional cap, such as a screw cap mounted thereon. The bottle with cap is sized and shaped, relative to the glass, to snap-fit substantially into the glass in an inverted and stable, substantially nested orientation, to provide a compact combined commercial unit. If desired, the glass with bottle contained therein can be sterile—contained within a plastic shrink-wrap film or the like.

The bottle with cap is sized and shaped, relative to the glass, to fit substantially into the glass in an inverted orientation with the bottle cap nested preferably within a shallow punt surrounded by an upstanding moat formed at the bottom of the glass. An upper body portion of the glass defines an upwardly narrowed flume of generally uniform thickness and having a smooth interior surface surrounding the inverted bottle and terminating in a smooth upper rim having a size and shape for substantially snap-fit reception into a matingly sized and positioned shallow groove formed in the inverted bottle at or near the base thereof. In a preferred form, this upper rim terminates in an arced configuration defining a short radially outwardly protruding lip for improved seating within the shallow bottle groove, and also for improved cooperation with shrink-wrap components for improved locking with an inverted bottle received therein.

Accordingly, in the combined or assembled state, the glass supports and substantially contains and surrounds the bottle, with the bottle base having a diametric size slightly larger than the mouth of the glass (as defined by the upper rim) for normally closing the bottle mouth. The glass and bottle are disassembled quickly and easily by lifted separation of the bottle from the glass, followed by bottle opening in a conventional manner by removal of the bottle cap to permit pouring of the entire bottle contents as a single serving with a single-pour action directly into the now-open and available glass for consumer enjoyment. After use, the glass and bottle can be economically disposed.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
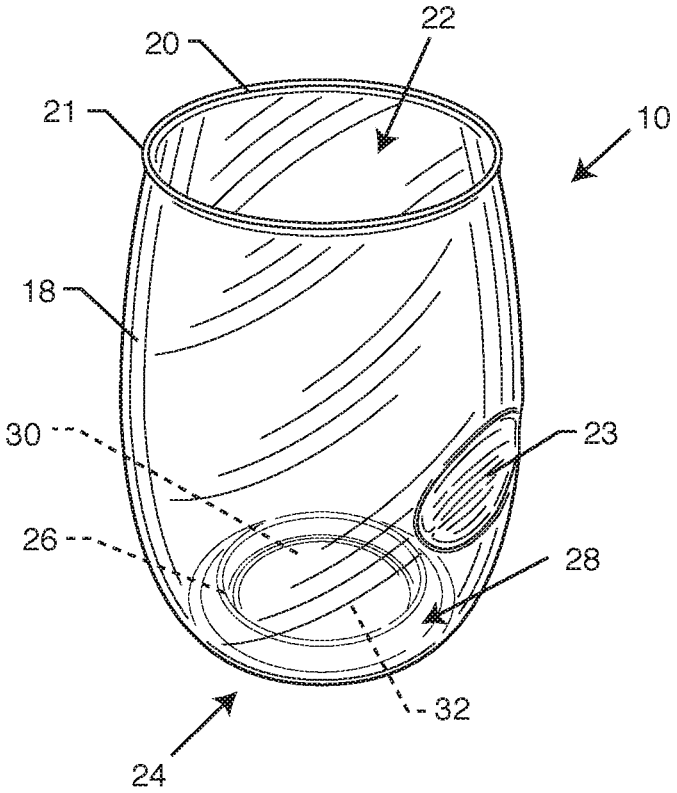
FIG. 1 is a perspective view illustrating a wine glass for use in the combined wine glass and wine bottle package disclosed herein.

As shown in the exemplary drawings, a wine glass referred to generally in FIG. 1 by the reference numeral 10 is constructed from molded plastic or the like and combined in a single commercial unit or package 12 (FIG. 2) with a wine bottle 14 formed preferably from glass or molded plastic or the like. In the preferred form (FIGS. 2-4), the wine glass 10 has a unitary or one-piece construction adapted to receive and support the wine bottle 14 in an inverted orientation substantially within the wine glass 10. If desired, the assembled wine glass 10 and wine bottle 14 can be maintained in a unitized commercial unit or package in a sanitary or sterilized condition as by way of a surrounding seal in the form of a shrink-wrap film 16 (FIG. 2) or the like.

The wine glass 10 as shown best in FIG. 1 is formed with a geometric shape that is specifically designed for enhanced enjoyment of substantially the full range of characteristics attributable to a specific wine 17 or other selected beverage. In this regard, the wine glass 10 can be constructed from a unitary molded plastic material suitable for blow molding or the like, such as PET plastic. The glass 10 includes an upper body or flume 18 of upwardly narrowing or upwardly converging cross sectional size and shape (at the upper end thereof) for concentrating the wine aroma or bouquet. This upper body or flume 18 is shown having a uniform thickness with a smooth interior surface that terminates in a smooth upper rim 20 defining a generally circular open mouth 22 for the wine glass 10. This smooth upper rim 20, in the preferred geometry, incorporates an arced configuration to include a short outwardly radiating upper lip 21 disposed immediately above a shallow indent 19. A noncircumferential notched indent 23 is desirably formed in the upper body or flume 18 at one side thereof, preferably at a generally centered vertical location as shown. In addition, a lower region or bottom of the wine glass includes a contoured lower base 24 defining an upstanding punt 26 surrounded by a recessed annular moat 28, and circumscribing a central component 30 such as the illustrative bowl or cup region having a relatively flat bottom wall 32. Further details of the construction and configuration of this glass 10 are generally found by reference to U.S. Pat. No. 7,273,147, and D577,547, and U.S. Publications 2007/0119726 and 2007/0144932, all of which are incorporated by reference herein. Persons skilled in the art will recognize, however, that alternative glass configurations may be used, such as, e.g., a modified base 24 which may or may not include the upstanding punt 26, and/or wherein the central component 30 includes a flat region 32 which may be in the form of a flat ring or flat step or the like surrounding a recessed central portion.

The wine bottle 14 (FIGS. 2-4) contains a selected liquid beverage such as wine, preferably in a single serving amount suitable for commercial packaging and sale with the single wine glass 10. Importantly, the wine bottle 14 is specially configured for assembly with the wine glass 10 to provide a stable and secure commercial package. In addition, the wine bottle 14 may be constructed from a gas-impervious material, such as glass, or from a suitable molded plastic material selected for prolonged beverage shelf life without adversely impacting the package stability or security.

Figure 2:
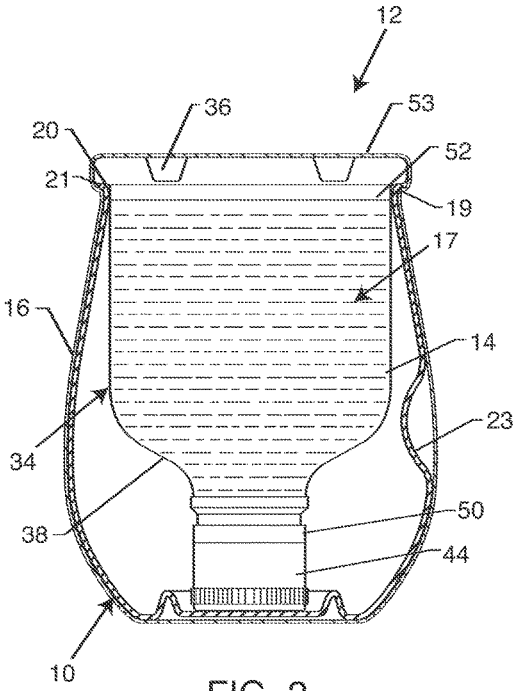
FIG. 2 is a vertical sectional view of the wine glass having an inverted wine bottle received therein to provide the combined wine glass and wine bottle package disclosed herein.
Figure 3:
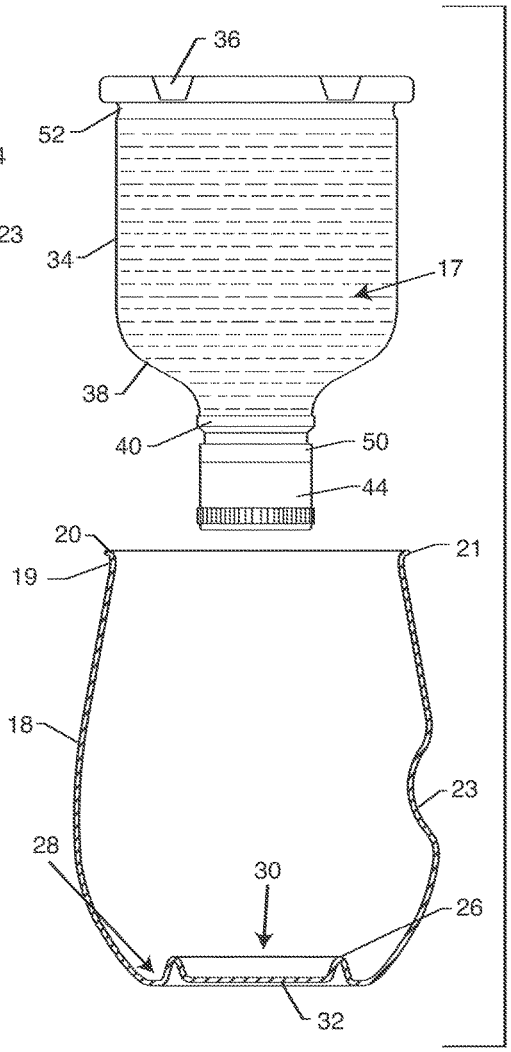
FIG. 3 is an exploded sectional view similar to FIG. 2, but showing the inverted wine bottle removed from the wine glass.
Figure 4:
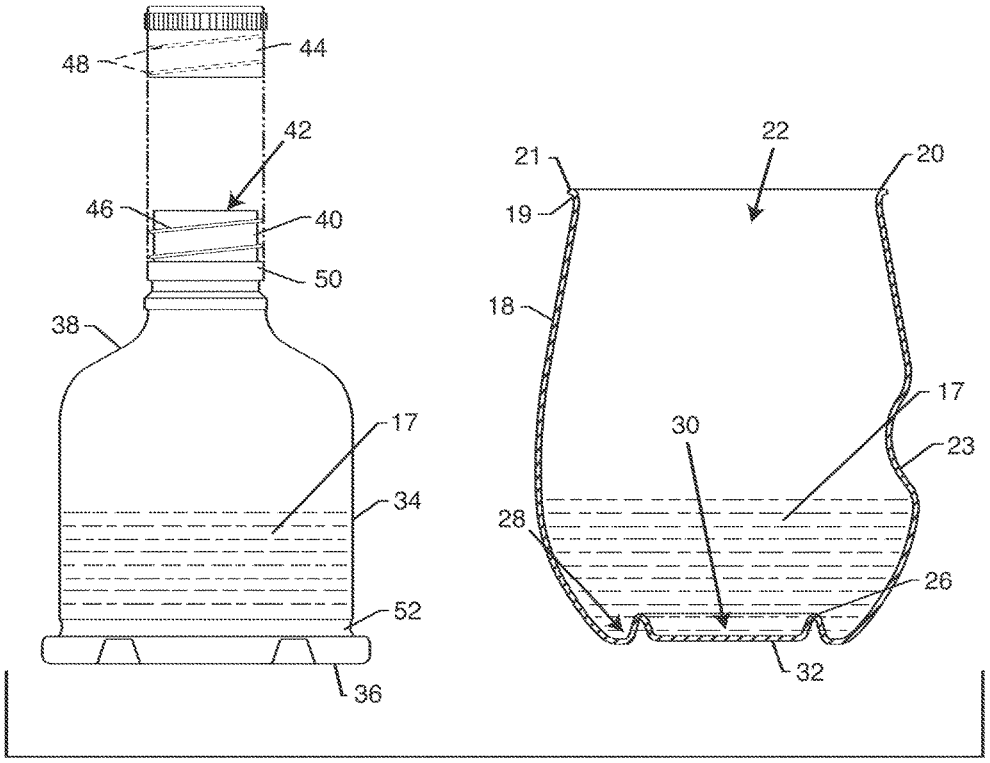
FIG. 4 is an exploded perspective view similar to FIGS. 2 and 3, but showing the wine bottle in an open condition with a portion of the contents thereof poured into the wine glass.

As shown in FIGS. 2-4, the wine bottle 14 comprises a straight-sided body 34 which merges or blends smoothly with a lower base wall 36 and also with an upper narrowing shoulder 38 which terminates in turn with a relatively small-diameter neck 40 defining a mouth or pour spout 42 for the bottle contents. A conventional cap 44 formed from plastic or metal or the like, and including internal seal components (not shown) is adapted for sealing mounting onto the bottle neck 40, as by way of inter-engaging threads such as the male threads 46 shown (FIG. 4) on the exterior of the bottle neck 40 for engaging mating female threads 48 on the cap interior. The cap 44 may also include a base ring 50 adapted for frangible separation from the cap 44 upon cap removal from the bottle neck 40. Persons skilled in the art will recognize and appreciate that alternative cap forms and related seals may be employed.

The bottle cap 44 is sized and shaped to have a substantially flat top for substantially nested reception preferably seated within the flat-bottomed central bowl or cup region 30 at the bottom of the wine glass 10, when the wine bottle 14 is placed into the wine glass 10 in an inverted orientation (FIGS. 2-3). In this position, the upstanding annular punt 26 and moat 28 as shown circumscribe the bottle cap 44 in a manner which seats and secures the inverted wine bottle 14 in a stable manner. The wine bottle 14 is in turn sized and shaped for fitting when inverted and nested substantially within the wine glass 10 (FIG. 2), with the base wall 36 of the wine bottle 14 extending across and essentially closing the glass mouth 22. Importantly, as shown best in FIG. 2, the wine glass 14 further defines a shallow recessed groove 52 at or near the bottom thereof, preferably at the juncture between the body 34 and the periphery of the lower base wall 36, for substantially snap-fit reception of the upper rim 20 of the plastic wine glass 10.

Accordingly, the wine bottle 14 is secured in a safe and stable manner, nested substantially within the volume of the wine glass 10, by way of the seated reception of the bottle cap 44 within the central bowl or cup region 30 of the wine glass, and also by way or the snap-fit engagement of the smooth glass rim 20 within the bottle groove 52. As previously noted, this assembled commercial unit may, if desired, by encased within an external seal 16 such as a plastic shrink-wrap film 53 (FIG. 2) or the like to keep the glass clean and ready for use, when the package is opened. When the arced upper rim 20 on the wine glass 10 is used, the shrink-wrap film 53 is beneficially drawn into the shallow recess 19 just below the upper lip 21 of the glass rim 20 to assist in retaining these components in the desired assembled relation.

FIG. 3 illustrates disassembly of the inverted wine bottle 14 from the molded plastic wine glass 10, subsequent to removal of the shrink-wrap film 53. FIG. 4 shows the wine bottle 14 in a normal upright condition, with the bottle cap 44 removed to expose the beverage contained within the wine bottle 14. Such beverage can be quickly and easily poured to empty the entire bottle contents into the upright wine glass 10 (FIG. 4) for examination and drinking enjoyment.

In one preferred form, in a single serving size, the wine glass 10 has a volumetric capacity of about 350 milliliters (ml), and the wine bottle 14 has a volumetric capacity of about 187 ml. In this regard, in the most preferred form, and as shown in FIG. 2, the wine bottle 14 includes sufficient unoccupied volume or "head" space, whereby the level of the beverage contained therein is at least slightly below the upper rim 20 of the wine glass 10, when the wine bottle 14 is assembled in an inverted orientation within the wine glass 10.

While the glass 10 and bottle 14 as disclosed herein are described in connection with a preferred beverage, namely, wine, persons skilled in the art will recognize and appreciate that the commercial unit or package may be used with virtually any liquid beverage including but not limited to water and soft drinks sold in a single serving size.

A variety of further modifications and improvements in and to the commercial unit or package 12 will be apparent to those persons skilled in the art. For example, when the wine bottle 14 is constructed from a molded plastic material, persons skilled in the art will recognize and appreciate that the glass 10 can be constructed from molded plastic or a glass material as desired. As another alternative, persons skilled in the art will understand that alternative cap and seals may be employed, with the top of such cap/seal being relatively flat for substantially nested reception into the relatively flat central bowl 32 circumscribed by the punt 26, when the bottle 14 is received into the glass 10 in an inverted orientation. Finally, while the foregoing description and accompanying drawings show the bottle 14 inverted for reception into the glass 10, persons skilled in the art will recognize that an inverse construction is also contemplated, namely, that the glass 10 may be inverted over an upright bottle 14. Accordingly, no limitation on the invention is intended by way of the foregoing description and accompanying drawings, except as set forth in the appended claims.

What is claimed is:

1. In combination:

a beverage glass having an upper shell-shaped body defining an upwardly narrowing tapered flume of entirely generally uniform thickness terminating in a smooth upper rim defining an open mouth and a contoured lower base defining a relatively flat central component substantially surrounded by an upstanding wall defining a smooth inner surface; and a bottle containing a liquid beverage and having an upper end defining a pour spout and a lower end having an external groove formed therein, said bottle being normally received within said beverage glass in a generally inverted orientation relative to said glass with said pour spout seated within said central component in substantially adjacent and spaced apart relation relative to the smooth inner surface of the upstanding wall, and with said glass upper rim of the upwardly narrowing tapered flume having a uniform thickness being received for substantial snap-fit reception into said external groove on said bottle.

2. The combination of claim 1, further comprising a seal member for sealing said bottle within said glass, said seal member being removable to permit access to and removal of said bottle from said glass, and to permit opening of said bottle and pouring of the liquid beverage therein into said glass.

3. The combination of claim 2, wherein said seal member comprises a shrink-wrap film extending about said bottle and said glass.

4. The combination of claim 1, wherein said glass is formed from an at least partially transparent material.

5. The combination of claim 1, wherein said glass is constructed from a molded plastic material.

6. The combination of claim 1, wherein said glass comprises an upper generally shell-shaped and transparent body terminating at said upper rim defining said open mouth, and a lower base at a lower end of said upper body, said glass further having an external noncircumferential notched indent formed therein and defining an upwardly presented exterior shelf.

7. The combination of claim 6, wherein said upper rim is defined by an arced configuration having a radially outwardly extending upper lip disposed above a shallow outwardly presented recess.

8. The combination of claim 6, wherein said lower base defines a recessed annular moat surrounding an upstanding central punt circumscribing said central component.

9. The combination of claim 1, further including a bottle cap for normally closing said pour spout, said cap having a relatively flat-topped configuration for stable seating within said central component when said bottle is mounted within said glass in said generally inverted orientation.

10. In combination:

a beverage glass formed from a molded plastic material and having an upper shell-shaped body defining an upwardly narrowing tapered flume of entirely generally uniform thickness terminating in a smooth upper rim defining an open mouth, and a contoured lower base defining a recessed annular moat surrounding an upstanding central punt defining a smooth inner surface circumscribing a relatively flat central component;

a bottle containing a liquid beverage and having an upper end defining a bottle cap for normally closing a pour spout and a lower end having an external groove formed therein, said bottle being normally received within said beverage glass in a generally inverted orientation relative to said glass with said central component being larger than said bottle cap such that said upstanding central punt is in spaced apart relation from an exterior surface of said bottle cap, and with substantially the entire circumference of said glass upper rim having a uniform thickness being received for substantial snap-fit reception into said external groove on said bottle; and a seal member for sealing said bottle within said glass, said seal member being removable to permit access to and removal of said bottle from said glass, and to permit opening of said bottle and pouring of the liquid beverage therein into said glass.

11. The combination of claim 10, wherein said glass is formed from an at least partially transparent material.

12. The combination of claim 10, wherein said glass includes a lower base at a lower end of said upper shell-shaped body, said glass further having an external noncircumferential notched indent formed therein and defining an upwardly presented exterior shelf.

13. The combination of claim 10, wherein the liquid beverage comprises wine.

14. The combination of claim 10, wherein said smooth upper rim includes a circumferential outwardly radiating upper lip complementary to said external groove on said bottle.

15. The combination of claim 10, wherein said central component is sized to selectively receive for seated reception therein a pour spout that varies in size.

16. In combination:

a beverage glass formed from a molded plastic material and having an upper shell-shaped body defining an upwardly narrowing tapered flume of entirely uniform thickness terminating in a smooth upper rim defining an open mouth, and a contoured lower base defining a recessed annular moat surrounding an upstanding central punt defining a smooth inner surface circumscribing a relatively flat central component;

a bottle containing a liquid beverage and having an upper end defining a bottle cap for normally closing a pour spout and a lower end having an external groove formed therein, said bottle being normally received within said beverage glass in a generally inverted orientation relative to said glass with said bottle cap having an outer surface relatively smaller than said upstanding central punt for reception therein in spaced apart relation, and with the entire circumference of said glass upper rim of said upwardly narrowing tapered flume having a uniform thickness being received for substantial snap-fit reception into said external groove on said bottle; and a seal member for sealing said bottle within said glass, said seal member being removable to permit access to and removal of said bottle from said glass, and to permit opening of said bottle and pouring of the liquid beverage therein into said glass.

* * * * *